US012240688B2

(12) United States Patent
Trude et al.

(10) Patent No.: US 12,240,688 B2
(45) Date of Patent: Mar. 4, 2025

(54) CONICAL WALL RISER WITH INTERLEAVED TAB CONNECTORS

(71) Applicant: Infiltrator Water Technologies, LLC, Old Saybrook, CT (US)

(72) Inventors: Gregory Trude, Bristol, CT (US); Paul R Holbrook, Old Saybrook, CT (US)

(73) Assignee: Infiltrator Water Technologies, LLC, Old Saybrook, CT (US)

( * ) Notice: Subject to any disclaimer, the term of this patent is extended or adjusted under 35 U.S.C. 154(b) by 0 days.

(21) Appl. No.: 17/898,476

(22) Filed: Aug. 29, 2022

(65) Prior Publication Data

US 2022/0411179 A1 Dec. 29, 2022

Related U.S. Application Data

(63) Continuation of application No. 15/432,780, filed on Feb. 14, 2017, now Pat. No. 11,427,400, which is a (Continued)

(51) Int. Cl.

| | |
|---|---|
| ***B65D 90/10*** | (2006.01) |
| ***B65D 21/02*** | (2006.01) |
| ***B65D 21/08*** | (2006.01) |
| ***B65D 88/02*** | (2006.01) |
| ***B65D 88/52*** | (2006.01) |
| ***B65D 90/02*** | (2019.01) |
| ***B65D 90/08*** | (2006.01) |

(52) U.S. Cl.

CPC ..... *B65D 90/105* (2013.01); *B65D 21/0209* (2013.01); *B65D 21/0212* (2013.01); *B65D 21/0234* (2013.01); *B65D 21/086* (2013.01); *B65D 88/025* (2013.01); *B65D 88/526* (2013.01); *B65D 90/024* (2013.01); *B65D 90/08* (2013.01)

(58) Field of Classification Search

CPC ..... B65D 90/02; B65D 90/08; B65D 90/023; B65D 90/024; B65D 90/025; B65D 90/026; B65D 21/0234; B65D 88/025; B65D 88/526; B65D 88/528; B65D 21/08; B65D 21/083; B65D 21/086; B65D 90/105; B65D 21/0209; B65D 21/0235; B65D 2519/00945; E03F 11/00; E03F 5/00; E03F 5/02; E03F 5/024; E03F 2005/028; E03F 5/105; B60K 2015/03164; B60K 2015/03171; E02D 29/12; E02D 29/121; E02D 29/1409; F16L 47/10

USPC ..... 220/4.16, 795, 4.26, 4.03, 691, 4.06; 52/79.3, 223.5; 285/420, 921, 110, 111

See application file for complete search history.

(56) References Cited

U.S. PATENT DOCUMENTS

| | | | | |
|---|---|---|---|---|
| 5,491,928 A * | 2/1996 | Potochnik | ..... | A01G 27/00 47/79 |
| 5,697,500 A * | 12/1997 | Walker | ..... | B65D 43/02 220/4.27 |
| 2013/0336723 A1* | 12/2013 | McKinney | ..... | B65D 90/105 405/129.55 |

* cited by examiner

*Primary Examiner* — Andrew D Perreault

(74) *Attorney, Agent, or Firm* — FINNEGAN, HENDERSON, FARABOW, GARRETT, & DUNNER L.L.P.

(57) ABSTRACT

A plastic article useful as a riser assembly for a septic tank or as part of another structure is comprised of a multiplicity of identical shape conical wall plastic risers. The risers are attached to each other at joints by tabs which engage rim segments; each end of the riser has alternating tabs and rim segments. A riser assembly wall undulates in the lengthwise direction. The risers nest within each other for shipment or storage.

14 Claims, 8 Drawing Sheets

Related U.S. Application Data continuation-in-part of application No. 14/444,960, filed on Jul. 28, 2014, now Pat. No. 10,442,617.

(60) Provisional application No. 62/295,408, filed on Feb. 15, 2016.

CONICAL WALL RISER WITH INTERLEAVED TAB CONNECTORS

This application is a continuation of patent application Ser. No. 15/432,780, filed Feb. 14, 2017, which claims benefit of provisional patent application Ser. No. 62/295,408 filed on Feb. 15, 2016 and which is a continuation in part of patent application Ser. No. 14/444,960, filed Jul. 28, 2014.

TECHNICAL FIELD

The present invention relates to molded plastic structures comprised of interlocked rings, useful as risers and manhole chambers, for providing access to such as buried septic tanks and utility lines, or as sidewalls of plastic storage tanks.

BACKGROUND

The purpose of the riser is to provide a space which extends upwardly within soil, for example from the access port of a septic tank to, or near to, the surface of the soil in which the tank is buried. A riser desirably inhibits entry of surface water and soil into the tank. Risers have been sold commercially as separate rings which can be assembled as a riser assembly having a desired length (height). Often, there have been seals or other means aimed at preventing the passage of water at the joints between rings. Most commercially available risers are essentially short straight cylinders. Thus they cannot be conveniently nested for economic shipment and storage.

Similar requirements are presented in connection with a hole in earth that provides access to a sewer line or other buried things by means of a manhole. A casing or liner, sometimes referred to as a chimney, extends downwardly from a manhole opening at the surface of the earth. In the present description the term riser shall be construed to embrace structures which are of the nature of risers for septic tanks and the like, are for manhole casings, and are for structures which are of the nature of sidewalls of vertical tanks.

A riser for septic tank application should have a minimum diameter which is no less than the diameter of the access port on the top of a septic tank, which commonly is of about 60 cm. In the past such risers have been provided either as a one piece structure, or as a multiplicity of circular rings which are commonly screwed or bolted to each other to form the desired height assembly. Good fit and seal between the joints of the rings is desirable, along with minimum labor of assembly. A riser desirably presents an uppermost surface suitable for a lid with a good seal configuration, particularly under conditions where surrounding soil may be prone to intruding into the seal region, as can occur when a lid is removed for septic tank maintenance purposes. There is a further need for a means of connecting any new-configuration riser to the opening of existing-design septic tanks and the ends of large diameter pipe-ends.

In recent times, there is a perception that means ought to be provided to hinder the chance of a small person or pet from falling into the large diameter opening of a typical septic tank riser during such time as the riser lid is removed. For instance, a grating might be placed on top of the open riser or within the riser. Thus it is desirable to have the option of such a feature while at the same time making the feature economic, to encourage its use.

In another application for articles of the present invention, a generally cylindrical plastic tank for holding liquids or solids may have a vertical axis and sidewall configured in the same way as a riser for a septic tank; that is, the sidewall is comprised of connected-together rings.

SUMMARY

An object of the invention is to provide molded plastic risers and related structures in forms which are economical to manufacture, ship, and store. A further object is to provide a riser comprised of a multiplicity of identical rings which form assemblies having good joints. Still further objects are to provide a safety grating for the new types of risers, and to provide an adapter for connecting the new types of risers to the tops of tanks and the ends of vertical pipes.

In accord with the invention there are individual risers and assemblies of identical risers. Each riser has a tapered side wall; that is, the circumscribing wall is in the shape of a truncated hollow cone, and a riser assembly has an undulating wall. Each riser has a first lengthwise end having a first diameter, and a second lengthwise end having a smaller second diameter. Each riser end comprises a plurality of tabs circumferentially spaced apart by rim segments. In exemplary risers, each tab has a body, at the end of which is a radially-extending lip shaped for latching engagement with the rim segment of a mated same-size end identical riser. Preferably, each tab comprises a body that is spaced apart from the exterior wall surface of the riser by a channel; and the lip extends radially over the channel. Preferably, the lips of the tabs at the larger end of the riser run inwardly and the lips at the tabs at the smaller end of the riser run outwardly.

In further embodiments of the invention, the riser like one just described comprises tabs having circumferential direction edges which are angled with respect to a plane within which lies the center longitudinal axis; and/or comprises a wall having a circumferential step which is closer in diameter to the smaller diameter second end than to the first end, for receiving the legs of a grating; and/or comprises a joint within which is captured a circumferential seal.

Further in accord with the invention, an exemplary safety grating for use within a riser comprises a hub and a multiplicity of arms attached to and extending radially outward from the hub. The arms are hinged where they attach to the hub, or at a location somewhat spaced apart from the hub. Thus, the grating can be diminished in size to enable the grating to fit through the smaller-opening end of a riser of the kind described above, so the grating may be moved lengthwise within the undulating wall riser, preferably to rest on a ledge or step molded on the interior of the wall of the riser.

Further in accord with the invention, an adapter comprises a flange end and a step-diameter end. The adapter is configured so it may be alternatively attached by the adapter flange to a septic tank opening or attached to the end of a pipe. The adapter has a interior ledge that enables attachment to the adapter of a riser of the present invention to the opening of a septic tank that was principally intended to receive a screwed or bolted flange.

The foregoing and other objects, features and advantages of the present invention will become more apparent from the following description of preferred embodiments and accompanying drawings.

DESCRIPTION

In the present invention molded plastic riser articles (sometimes referred to as rings) can be used individually or as assemblies. As will be seen, risers have inward or outward tapering walls, also referred to as conical walls. For simplicity of description, the risers and riser assemblies are often described herein using terminology applicable to cylindrical shapes. While the invention is described in terms of circular rings/risers, the scope of the claimed invention includes articles which have walls which are non-circular, e.g. oblong; and those shall be considered equivalents.

The following description concentrates on an exemplary product and application, namely a riser for a septic tank. A riser is an open ended structure which may be closed by a lid when positioned on a tank. In the present invention, a riser may be mated with one or more other risers to form a riser assembly. In the art, a riser assembly may be also referred to simply as a riser. In this description and elsewhere a single riser piece may be alternatively referred to as a ring.

The disclosures of commonly owned patent application Ser. No. 62/295,408, filed Feb. 15, 2016, entitled "Multi-ring plastic riser with tab connectors", and patent application Ser. No. 14/444,960, filed Jul. 28, 2014, entitled "Multi-ring plastic storage tanks and risers" (the "'960 application") are hereby incorporated by reference.

Figure 1:
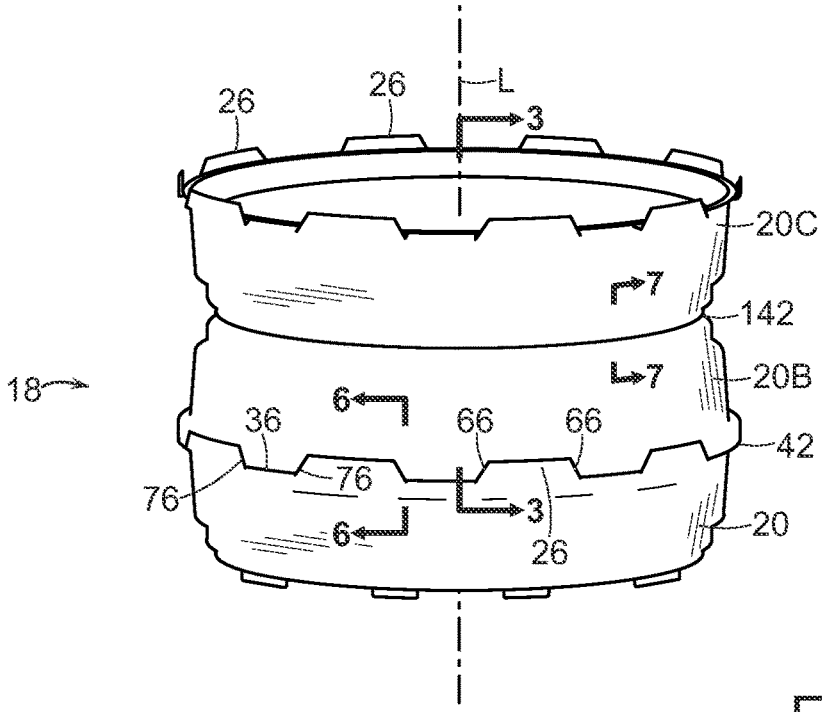
FIG. 1 is a perspective view of a riser assembly comprised of identical risers.
Figure 2:
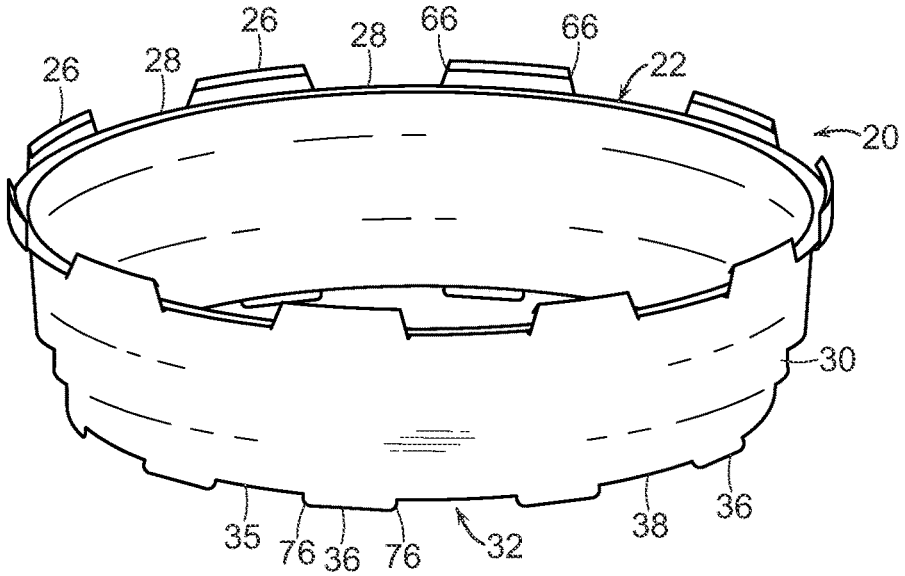
FIG. 2 is a perspective view of a riser which is part of the assembly of FIG. 1.
Figure 3:
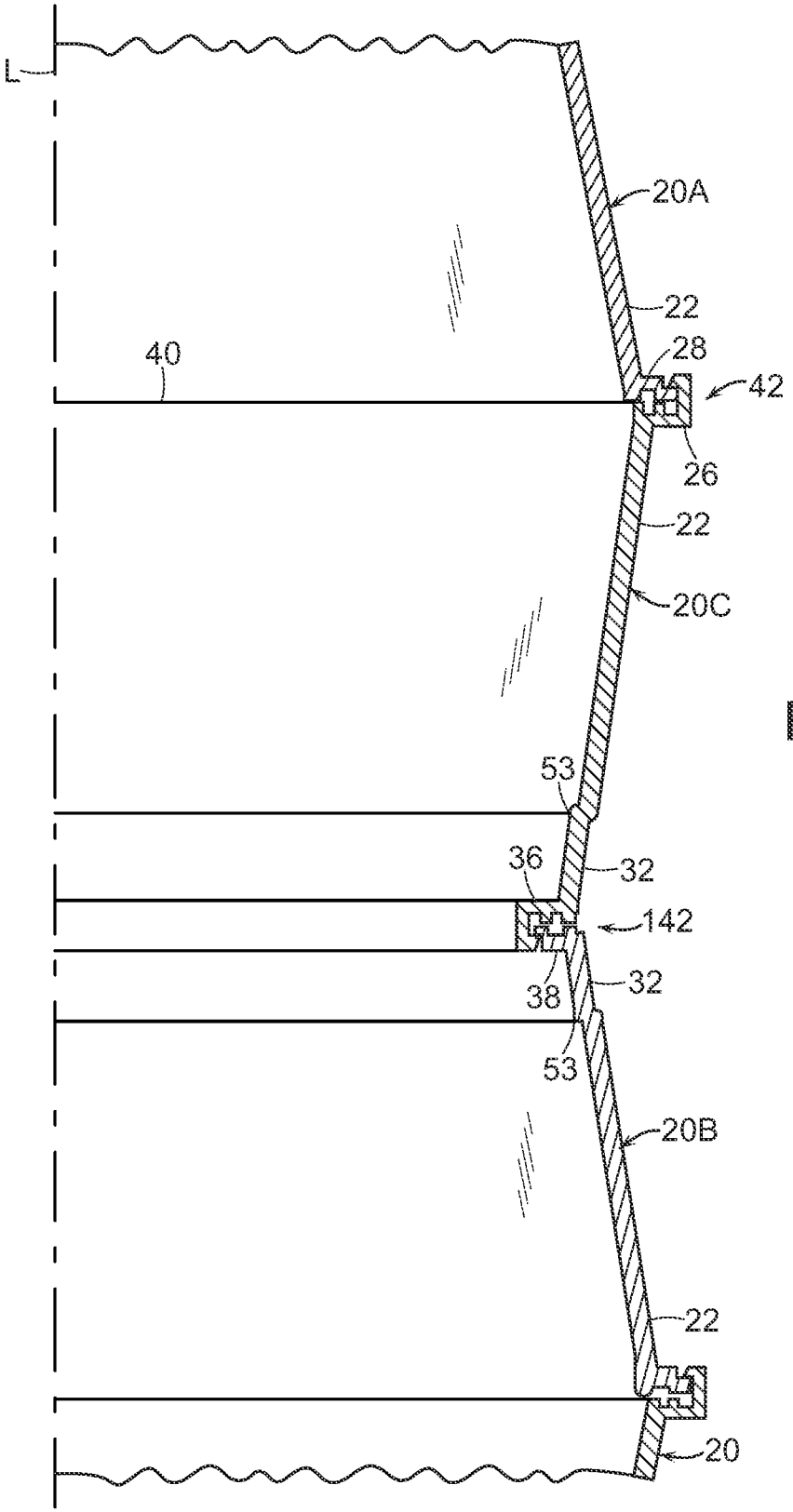
FIG. 3 is a partial vertical cross section through the riser assembly of FIG. 1, with an additional riser added at the top of the assembly.

FIG. 1 is an elevation perspective view, showing three identical risers 20, 20B, 20C that are joined to each other as riser assembly 18. A single riser 20 is shown in FIG. 2. FIG. 3 is a cross section through the assembly of FIG. 1, with addition of a further riser 20A. The small end of riser 20B mates with the small end of riser 20C at joint 142. The large end of riser 20A mates with the large end of riser 20C at joint 42. The wall of the riser assembly undulates in the lengthwise direction, so the wall is close to the central axis at circumferential joints 142 and distant at circumferential joints 42.

A riser assembly of the present invention may comprise two or more mated and latched-together articles. A riser assembly may sometimes be simply called a riser herein, particularly when the assembly is installed in a working position. When installed on a septic tank, a riser assembly is typically fastened to a fitting around the opening in the top of the tank and the assembly has a lid closure at its top. An exemplary lid closure is consistent with the lid shown in FIG. 8-10 of the aforementioned '960 application.

An exemplary riser 20 may have a vertical height of about 15 cm (about 6 inch), a larger diameter end of about 69 cm (about 27 inch) and a smaller diameter end of about 58 cm (about 23 inch). Other risers may have heights in the range 2 to 18 inches (5 to 46 cm). Joints between several identical risers 20 are formed by tabs on one part that engage rim segments on the mating part by latching to them. An exemplary riser is preferably made of injection molded thermoplastic, such as polyethylene or polypropylene, with a wall thickness of about 4.5 mm (about 0.18 inches). Alternative plastic materials may be used.

Riser 20 has a lengthwise central axis L, around which is centered a wall 30 that generally has the shape of a truncated hollow cone. The wall of riser 20 has opposing ends 22, 32. End 22 has a larger diameter than does smaller end 32. The wall of an exemplary ring is preferably inclined at an about 7 degree angle to the lengthwise axis L, more generally, preferably within the range 5-20 degrees.

Figure 5:
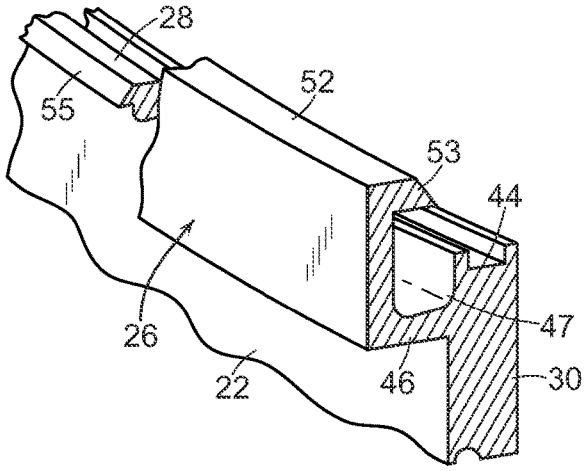
FIG. 5 is another perspective view of a portion of the large end of the riser in FIG. 3.
Figure 6:
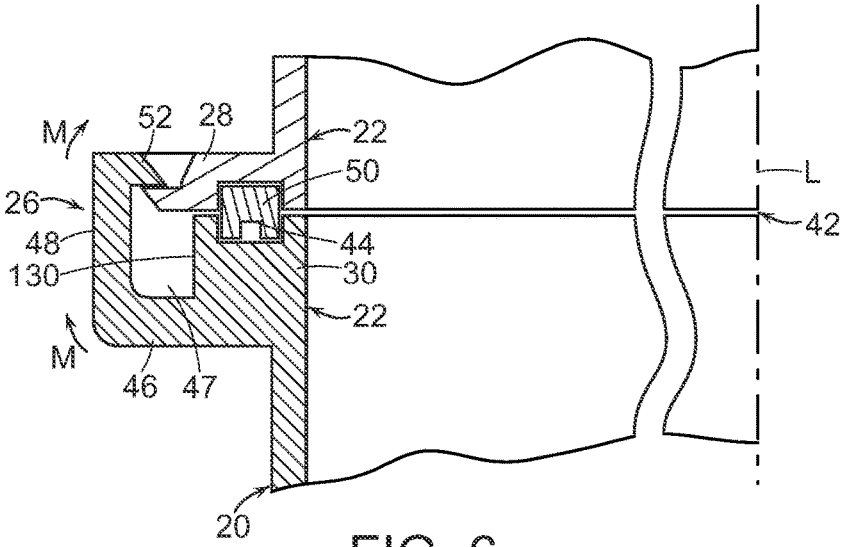
FIG. 6 is a vertical cross section through the large-end joint region of the riser assembly of FIG. 1.

As best seen in FIGS. 1, 2 and 5, the larger end 22 of a riser 20 is characterized by a plurality of tabs 26 which are circumferentially spaced apart by rim segments 28. Rim segments may be referred to as simply "rims" hereafter. The tabs extend in the lengthwise direction from the exterior surface of the wall of the riser. Each tab has a lip 52, for latching onto the rim segment 28 of a mated like riser. The inner edges of the lips are disposed around a circle. The outer edges of the rim segments are disposed around a circle which is congruent with the circle of the lip edges. A joint 42 between risers is formed when the plurality of tabs 26 of one riser are engaged with a plurality of rims 28 of a mating riser. Likewise, joints 142 are formed between mated riser smaller ends. See the cross sections at joint locations in FIG. 3. FIG. 6 shows an added gasket 50 captured in a circumferential channel 44 that is associated with joint 42. Gaskets may also be included in joints 142.

FIG. 3 shows an optional step 53 in the wall 30 proximate the small end of riser 20C; this is discussed below in connection with a safety grating which optionally rests on the step.

Figure 7:
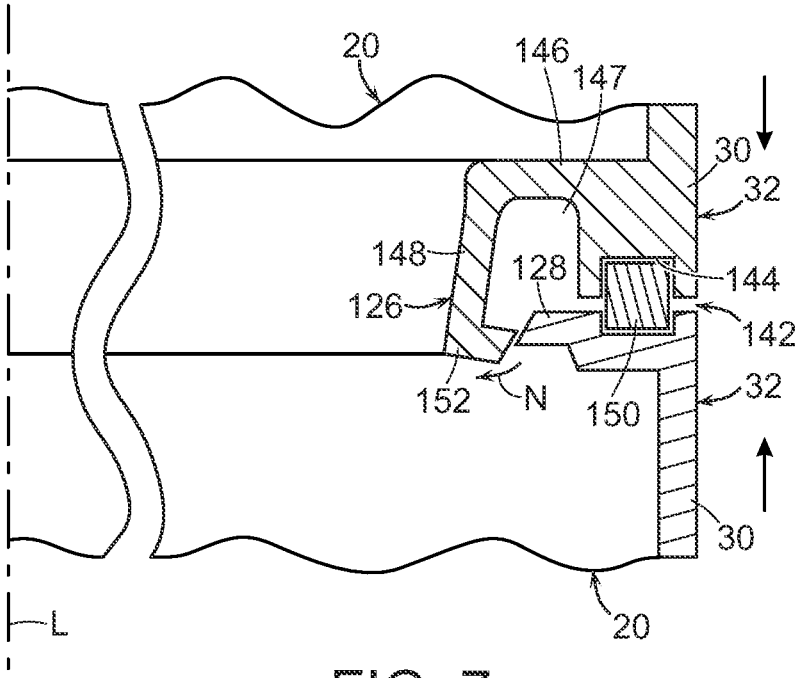
FIG. 7 is a vertical cross section through the small-end joint region of the riser assembly of FIG. 1.

Referring to FIGS. 1, 2, and 7, the smaller end 32 of a riser 20 has many similarities with larger end 22, but also some differences. Smaller end 32 is characterized by a plurality of tabs 36 which are circumferentially spaced apart by rim segments 38, which may be referred to simply as rims hereafter. Joint 142 is formed when the plurality of tabs 36 are engaged with a plurality of rims 38 of a mating riser. Each tab 36 has an outward facing lip 152. When two risers are mated, each lip 152 engages a rim 128. See the assembly cross section at joint 142 in FIG. 3 and FIG. 7. A gasket 150 is preferably captured within a circumferential channel 144 at the circumferential end of the wall of each riser, to seal joint 142. See FIG. 7.

When used, gaskets 50, 150 are preferably made of a rubber or elastomer material, for example EPDM having a Shore A hardness number of about 30. Optionally, where resistance to water passage through the joint is not important to the user, the risers can be assembled without the use of a gasket, and risers may be constructed without a channel 44. See FIG. 6A, discussed below.

Exemplary riser 20 has ten tabs 26, 36 at each end. Preferably, the tabs at one end are aligned in the lengthwise direction with the tabs at the other end of the riser. In other embodiments of the invention, there may be fewer or more tabs; and there may be a different number of tabs at one end, compared to the other end.

Figure 4:
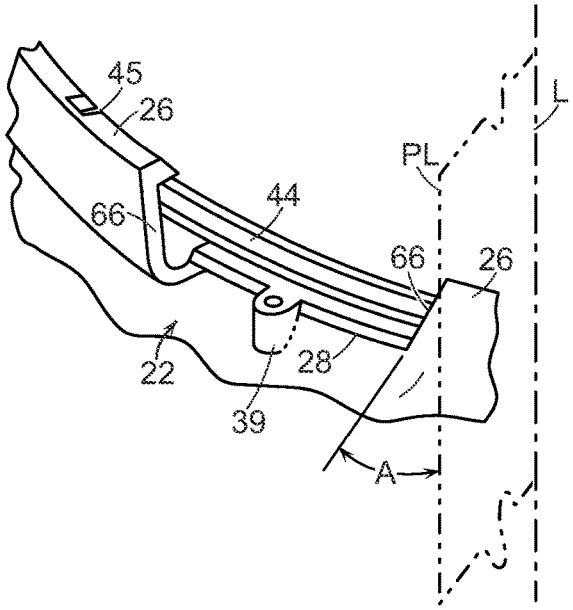
FIG. 4 is perspective view of a portion of the large end of the riser in FIG. 3.

FIGS. 4 to 7 illustrate certain features of the ends of a riser which enhance the convenient making of a good joint with a like riser. (This portion of the description interchangeably applies to the small ends and large ends of risers.) FIG. 4 and FIG. 5 are perspective views of portions of the larger end 22 of riser 20. They show that each tab 26 has an inward facing lip 53 and that rim 28 runs circumferentially between two spaced apart tabs. Also, each tab 26 has circumferential direction-facing ends 66 which are canted at angle A to a lengthwise diametrical plane PL, shown in phantom, within which plane lies lengthwise axis L. The angled ends 66 enable easier engagement of the tabs of two mated risers, as each tab of a first riser nestles into the space between the tabs of the mating second riser, so that each tab engages a rim segment. FIG. 1 shows that in a resultant assembly 18, the angled ends 66 of each tab 26 of a first riser 20 mate/abut the angled ends 76 of spaced apart tabs 36 of the second riser, so that interleaved tabs appear continuous around the circumference of the joint 42.

With particular reference to FIG. 5, lip 52 of tab 26 has an inner edge 53 which is angled with respect to the diametrical plane of the riser, so that the tab is thrust elastically outwardly when the lip of the tab first engages with rim 28 of a mating riser. For the same reason, the outer edge 55 of rim 28 is angled with respect to the diametrical plane.

FIG. 6 is a cross section through the riser assembly 18 at joint 42. FIG. 6 shows how the large ends 22 of risers 20 mate; the small ends will mate comparably. FIG. 6 shows lip 52 of tab 26 is engaged with rim 28. Seal 50 is captured in the groove 44. As pictured in cross section, tab 26 has a body 48, which is the lengthwise extending portion of the tab (i.e., the vertical portion in FIG. 6). Tab body 48 is an arc-shape structure that runs circumferentially, congruently with wall 30 and with the rim segments of the riser. One lengthwise end of tab body 48 is connected to the exterior wall of riser end 22 by radially inward-running web 46 (which is a horizontal section shown in FIG. 6). The other lengthwise end of the tab body extends beyond the end of the wall where the joint 42 is formed. As described in more detail below, in a preferred injection molded riser, the web 46 may be discontinuous in the circumferential direction.

The combination of elements 48, 46 and local portion 130 of wall 30 defines circumferentially-running channel 47 (which has a length nominally equal to the tab width). Channel 47 provides an advantageous arrangement for the following reasons: When force is applied to the risers, to separate the risers from each other at the joint 42, a bending moment (represented by the curved vectors M) is created in web 46. That moment has the effect of thrusting section 48 and lip 52 radially inwardly, toward the central axis L of the riser, better to engage rim 28. That enhances the resistance of the joint to separation, compared to the resistance which the assembly would have if channel 47 and section 46 were not present, i.e., compared to the structure shown in FIG. 6A. Secondly, by increasing the effective length of the tab body, even without the foregoing phenomenon, deflection of tabs by contact with rim segments, and thus engagement of mating parts, is made easier.

Figure 6A:
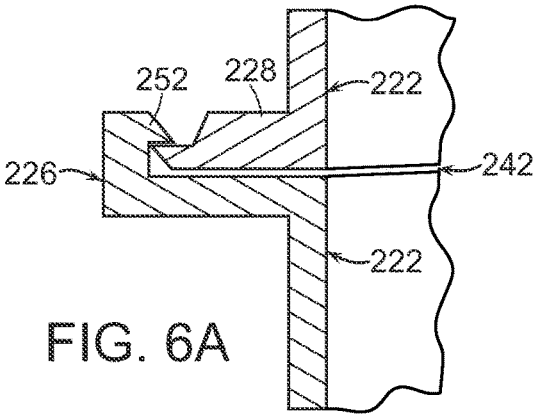
FIG. 6A is a view like FIG. 6 showing a joint which lacks a seal and a channel between the wall and latching tab.

FIG. 6A shows two mated risers 222, and illustrates an alternate embodiment of the invention. One of a plurality of tabs and rim segments is shown. Joint 242 is formed between two mated risers 222 when lip 252 of tab 226 engages rim segment 228. First, the risers 222 lack any optional circumscribing channel for a seal between the mating parts. Second, there is no channel like channel 47 that spaces the tab body away from the end of the wall, as there is in the embodiment shown in FIG. 6. See also FIG. 11 and related discussion, where the tab body is also not spaced apart, but is a lengthwise continuation of a portion of the wall.

FIG. 7 is a cross section through the riser assembly 18 at joint 142, showing how the small ends 32 of risers 20 mate. The ends are shown as they are being moved toward each other to their final joined-together configuration, as indicated by the vertical arrows. Tab 126 has a construction like tab 26. Lip 152 is at the end of tab body 148, which is connected to web 146 that extends radially from the wall 30 of riser 20 at small end 32. (As mentioned, lip 152 faces outwardly from the center of the riser, which compares with inward-facing lip 52 of tab 26.) In FIG. 7, the engagement of lip 152 with rim 128 and movement of the risers toward each other causes lip 152 to be deflected radially inwardly as indicated by arrow N. This action is facilitated by the angled terminal ends of lip 152 and rim 128, previously discussed.

Once the mating features of the ends are engaged, the risers cannot conveniently be separated other than by use of tools which pull all tabs from engagement with the mating rims. It is not expected that a user will often seek to separate the risers once they are joined to each other.

Referring again to FIG. 4, each of the plurality of rim segments 28 may be interrupted by a boss 39, which is nominally in the center of the rim segment. Boss 39 is shaped so it can receive a screw, thus enabling the end of the riser to be fitted with a screw-attached lid. When boss 39 is present, a notch 45 is preferably present in the lip of the tab which is shaped to engage the rim segment, to accommodate the boss 39 and screw.

Figure 8:
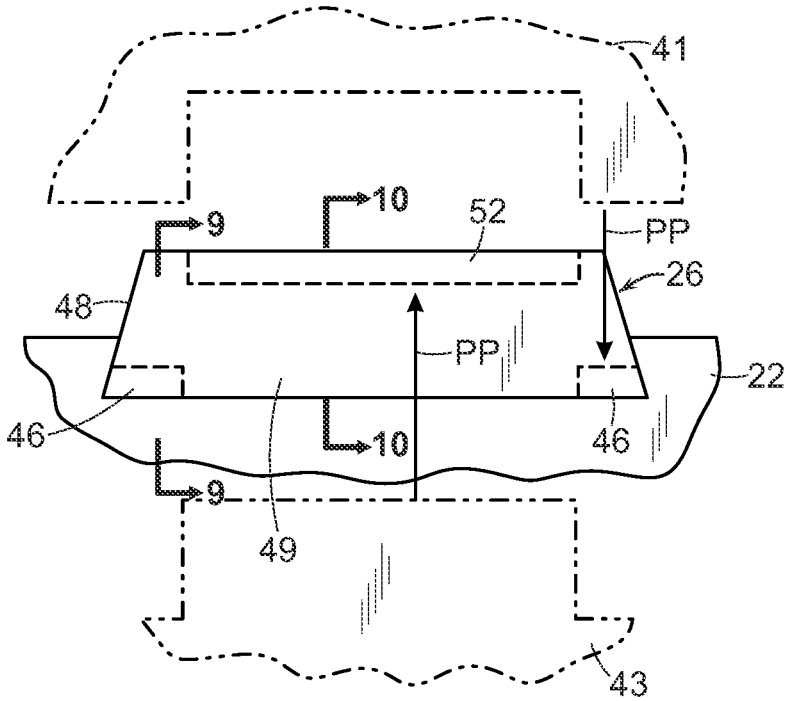
FIG. 8 is a side view of the end of a riser showing a latching tab and (in phantom) portions of tooling which enables the riser to be injection molded.
Figure 9:
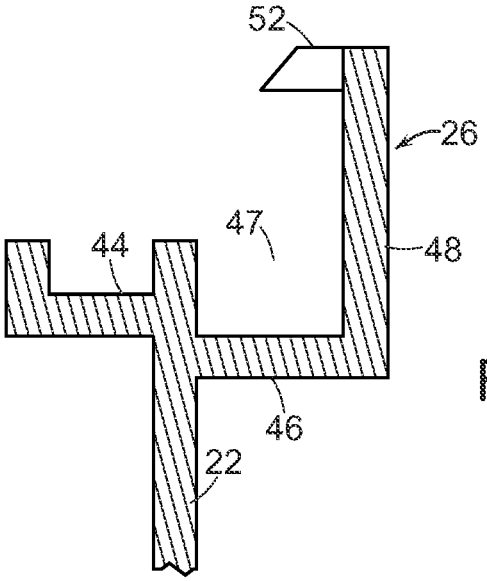
FIG. 9 is a vertical plane cross section through the structure of FIG. 8, near the end of the tab.
Figure 10:
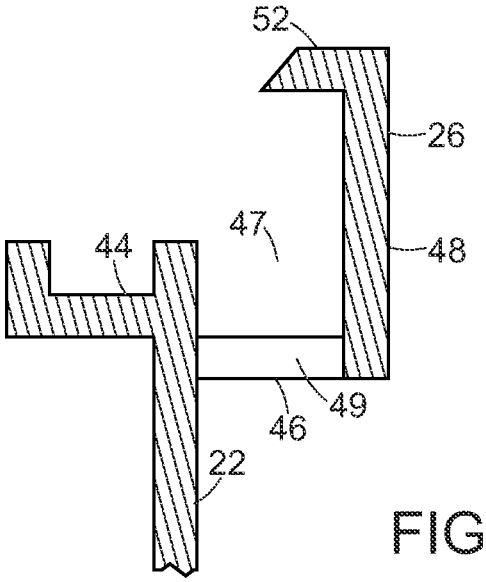
FIG. 10 is a vertical plane cross section through the structure of FIG. 8, near the middle of the tab.

FIG. 8-10 show in more detail other aspects of a tab of a preferred injection molded riser 20. The tab is mated to the wall of the riser by a web that is comprised of two spaced apart portions, which facilitates manufacture. FIG. 8 is a side view of a portion of the end 22 of a riser showing tab 26. FIG. 9 and FIG. 10 are vertical plane portions through the tab and riser end shown in FIG. 8. Also shown in FIG. 8, in phantom, are mold parts 41, 43 in their spaced apart (or "open mold") condition. The arrows PP show how the mold parts 41, 43 move toward each other when the mold is closed so plastic can be injected into the mold.

With reference to FIG. 8, 9, 10, there is a space 49 between the two circumferentially spaced-apart portions of web 46. Space 49 is created by mold part 43. When the tab has the configuration which comprises space 49 that enables mold part 43 to create the underside surface of lip 52. An alternative embodiment of tab may have a web 46 which is continuous from one circumferential edge of the tab to the other. In such case, a more complex mold may be necessary for efficient injection molding.

Figure 11:
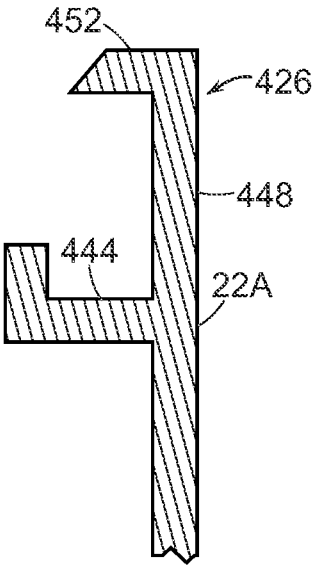
FIG. 11 is a view like FIG. 9, showing an alternative embodiment of tab where the tab is not spaced apart from the wall at the end of the riser.

FIG. 11 is a view like FIG. 9, showing an alternative embodiment tab 426 at the large end of a riser. There is no channel like channel 47; tab body 448 is a continuation of a portion of the riser wall. Lip 452 overhangs the channel 444 within which a seal will be placed prior to a joint between risers being made.

The next paragraphs describe a safety grating that is particularly useful with the foregoing kinds of conical risers which have different diameter ends, compared to known safety gratings which are used with more or less constant diameter risers of the prior art.

Figure 12:
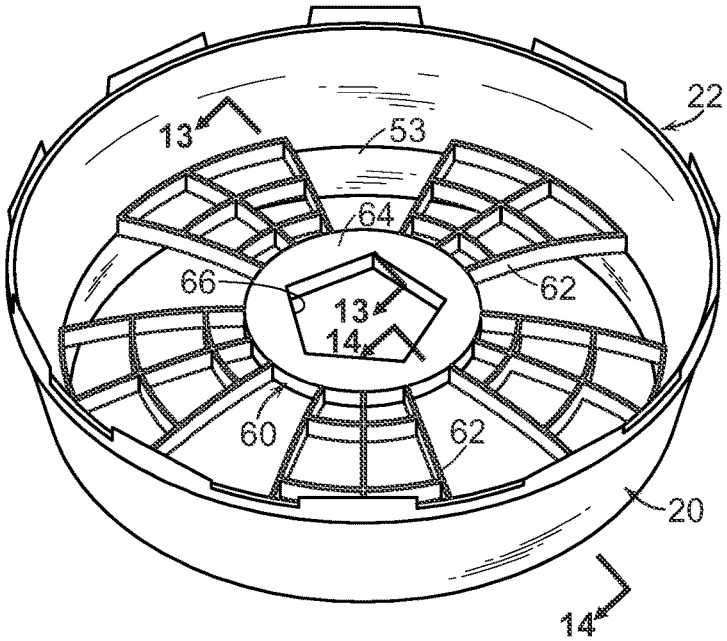
FIG. 12 is a perspective view of a riser with a safety grating positioned within the bore of the riser.
Figure 14:
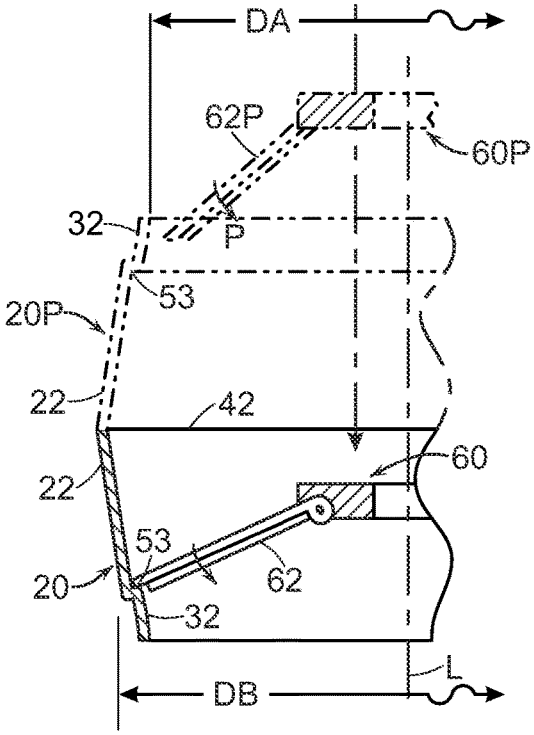
FIG. 14 is a partial vertical cross section of the assembly of FIG. 12, showing in phantom an additional riser, along with the grating as it was being inserted into the riser assembly from the top.
Figure 13:
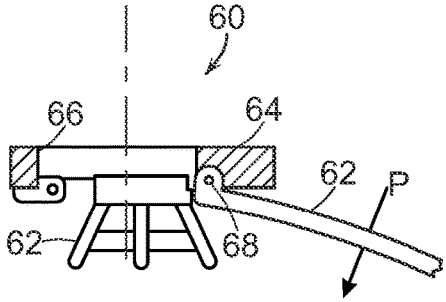
FIG. 13 is a partial vertical cross section of the grating shown in FIG. 12.

FIG. 12 is a perspective view, looking down on the larger end 22 of riser 20. Grating 60 is set within the bore of the riser. FIG. 13 is a side elevation view of a portion of the grating 60 (also referred to as a grate). Exemplary grating 60, preferably made of plastic like that of the associated riser, comprises a hub 64 having a pentagonal opening 67. The first ends of five lattice-like arms 62 are attached to the hub at hinge points 68 and extend generally radially outwardly from the hub. The free or outer ends of the arms are in contact with circumferential step 53 on the interior wall of riser 20, near the small end 32 of the riser. See FIG. 3, FIG. 12, and FIG. 14 which is a partial vertical cross section of the grating and riser assembly shown in FIG. 12. The length of the arms 62 and size of hub 64 are such that, as shown by FIG. 14, the grate, in riser lengthwise cross section view, has a cross section which is substantially in the shape of an arch. Thus any vertical load placed on the grate (such a child, pet, or other object entering the open top of the riser assembly) may be substantially resisted by the grate and hindered from moving further downward. The ends of the legs are constrained from outward and downward movement by the riser wall circumferential and vertical structure.

Importantly, arms 62 are hinged. The hinging enables placement of a grating by passing the grating through the small end of a riser, for example, the small end of riser 20P which has a diameter DA of the opening of an imaginary cylinder, as shown in phantom in FIG. 14. The arms 62 hinge inwardly, as indicated by arrow P in FIG. 14 for arm 62P of riser 60P, both shown in phantom, as the grating is being inserted into the riser assembly. The hinging makes the effective outside diameter of the grating smaller than the diameter DB which the grating has when in its working position. Effective outside diameter refers to the diameter of the smallest imaginary short cylinder through which a grating may be passed lengthwise.

Referring again to FIG. 1, it can be appreciated that hinging is necessary to position a grating within the lowermost riser 20 of assembly 18 when the grating is lowered from the top. An exemplary grating of the present invention compares with a prior art grating having an unchangeable effective outside diameter. The grating of the present invention may be used on risers other than those described herein.

Springs (not shown) may be employed to bias the arms in the outward, or most-extended, direction. For example, a torsion spring may be put around the pin of the hinge joint, when the hinge joint has appropriate construction. For example, compressible elastic bumpers may be used to resist the inward or collapsing motion of the arms. Likewise, the movement of one arm may be interlocked with the movement of adjacent arms, so all arms move radially outward or inward in coordination. The interlocking may be on the nature of a flexible tang which is fixed to one arm and extends in the circumferential direction, from the one arm to engage slidingly a surface of an adjacent second arm.

An alternative embodiment grating may have one or more arms which are not hinged in combination with at least one, or more than one, arm which is hinged. In a functionally-limiting embodiment of the invention, hinged arms need only be in number sufficient to decrease the effective outside diameter of the grating, so that such effective diameter is smaller than the small end opening of a riser like riser 20 (or the opening of an imaginary cylinder associated with the small end opening, with which the grating is used. Thus there is an embodiment which has only one hinged arm.

Figure 15:
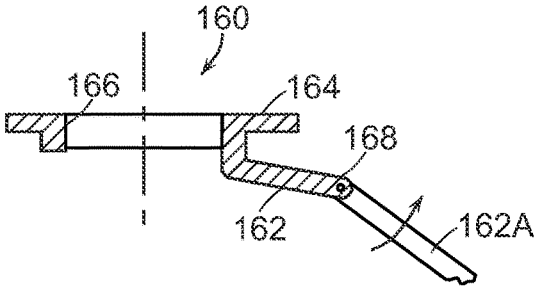
FIG. 15 is a view like FIG. 13, showing an alternative embodiment grating.

In still another alternative embodiment of grating, illustrated by FIG. 15, the hub 164 of grating 160, having a bore 167, has at least one, and preferably a multiplicity, of fixed arm portions 162, each of which has a movable arm portion 162A. The portion 162A is attached to the portion 162 at hinge point 168, which is radially outward from the point where the arm portion 162 connects to the hub.

A grating within the present invention may have a number of arms which is different from five arms of exemplary grating 60. For example, 3, 4, or 6 or more arms may be used. And although a correlation between the number of polygon sides of the center opening with the number of arms is preferred (i.e., pentagonal for five arms, hexagonal for six arms, etc.), in alternative embodiments of the invention the shape of the center opening may be uncorrelated with the number or arms. In further alternative embodiments, the opening may be round or there may be no opening. When an opening is present, it is preferably sufficient in diameter to allow passage of a hose line, but not a child's body, to facilitate pumping out of the septic tank without removal of the grate.

The following paragraphs describe adapters which are particularly useful with the foregoing kinds of risers which have tapered walls, also referred to as conical walls.

Figure 16:
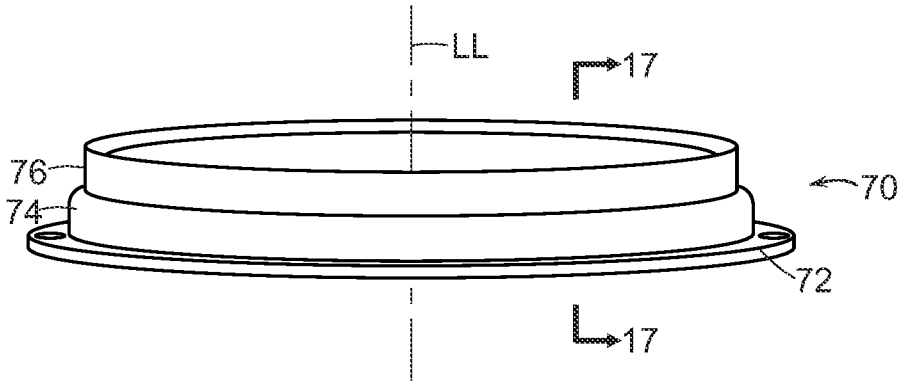
FIG. 16 is a perspective view of an adapter for connecting a riser to the top of a septic tank or to the end of a piece of pipe.
Figure 17:
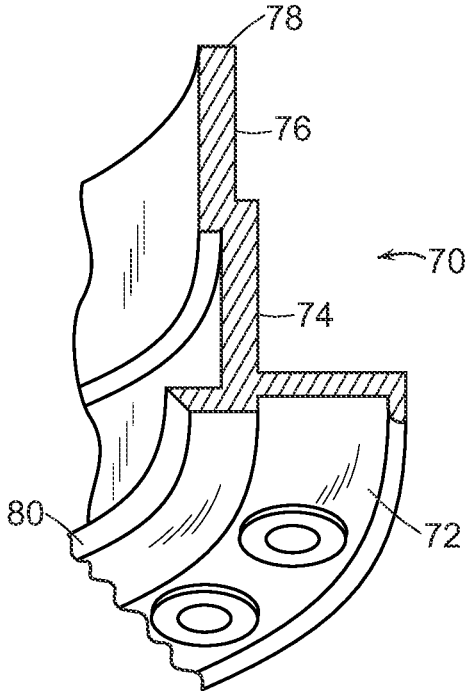
FIG. 17 shows a portion of the adapter of FIG. 17 in partial vertical cross section.

FIG. 16 shows in perspective an exemplary adapter 70 having lengthwise central axis LL, and FIG. 17 is a partial cross section. Adapter 70 which has multiple uses, including (a) enabling attachment of the small end of a riser of the present invention to the top of a tank, such as a septic tank; (b) enabling attachment of a corrugated pipe or prior art riser or other future riser to the top of a tank; and (c) enabling a riser of the present invention to be attached to the end of a corrugated pipe or to a prior art riser, or vice versa.

Adapter 70 has a first larger end comprising flange 72, and has a second end 78 comprising cylindrical section 76 which has a diameter smaller than the outside diameter of adapter flange 72. An intermediate size section 74 connects the section 76 with the flange. Within the bore of the first end flange is inward projecting ledge 80. Ledge 80 has an inside diameter and other dimension which preferably corresponds with the effective diameter of the rims 128 at the smaller end 32 of a riser 20.

Figure 18:
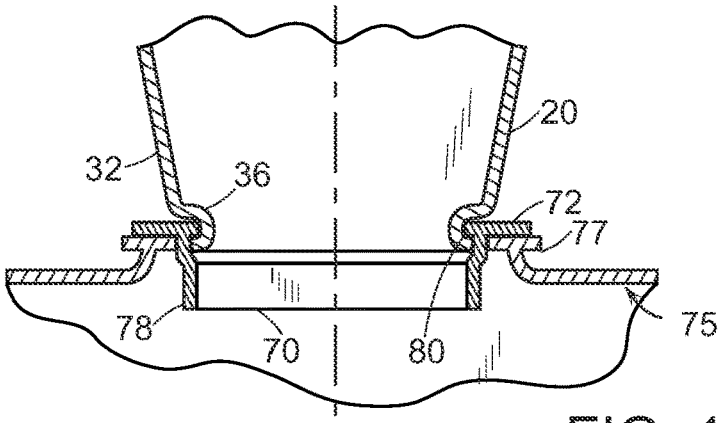
FIG. 18 is a partial cross section showing how a taper wall riser is connected to the top of a septic tank by means of an adapter of FIG. 16.

When a septic tank has an opening with a top flange that has a suitable inward extending rim, the small end of a riser 20 of the present invention can be snapped onto the tank top flange, and the tabs will latch onto the rim. When the tank does not have such a suitable top flange, as illustrated by flange 77 of tank 75, the adapter flange 72 can be screwed or otherwise attached to the flange 77, as shown in the partial vertical cross section of FIG. 18. In FIG. 18, tabs 36 of riser 20 are shown after they have been engaged with ledge 80 of the adapter.

Figure 19:
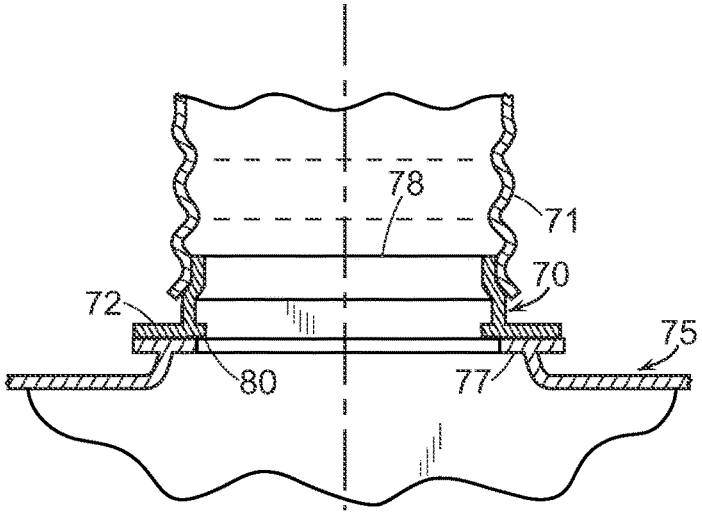
FIG. 19 is a partial cross section showing how a piece of pipe is connected to the top of a septic tank by means of an adapter of FIG. 16.

FIG. 19 shows how the adapter 70 can be used to mount a piece of pipe (or other item having a suitable diameter) on the top of a tank. The small end 78 of adapter 70 faces in the upward direction (away from the interior of the tank 75) and the flange 72 is screwed or otherwise attached to the rim 77 at the septic tank opening. A corrugated pipe 71 is shown mounted on the section 76 at the small end 78 of the adapter; alternatively, the pipe fits the intermediate section 74.

Figure 20:
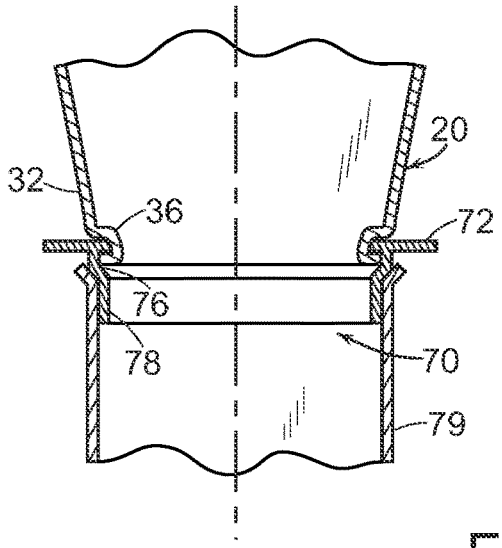
FIG. 20 is a partial cross section showing how a taper wall riser is connected to the end of a piece of pipe by means of an adapter of FIG. 16.

It is sometimes desired replace a portion of a prior art riser that is spaced apart from the tank, or to add to the length of a prior art riser. FIG. 20 shows how the small end 78 of adapter 70 is inserted into the top of a riser 79 that does not have an end that mates with a riser of the present invention. Adhesive and or radially-running screws may be used to fasten adapter 70 to the original in-place riser 79. Then riser 20 of the present invention is inserted into the opening of flange 72 and the tabs at the small end 32 of the riser become engaged with the ledge 80 of the adapter.

Assembled structures embodying features of the present invention may be put to other uses including, for example, manhole sleeves for access to subterranean chambers. An open ended hollow article like a riser, made in accord with the invention, may be fitted with a bottom closure (and optionally a top also), thus making the article into a bucket or tank like vessel, suitable for storing water, other liquids, or solid items. A claim to a riser shall be construed as comprehending a structure which may be used for a manhole in the earth or other material, or for a structure which forms part of a vessel. For convenience of description, the invention has at least in part been described with respect to a particular orientation, and such terms as top, bottom, side, etc., that relate to orientation shall not be construed as limiting with respect to the claims.

The invention, with explicit and implicit variations and advantages, has been described and illustrated with respect to several embodiments. Those embodiments should be considered illustrative and not restrictive. Any use of words such as "preferred" and variations suggest a feature or combination which is desirable but which is not necessarily mandatory. Thus embodiments lacking any such preferred feature or combination may be within the scope of the claims which follow. Persons skilled in the art may make various changes in form and detail of the invention embodiments which are described, without departing from the spirit and scope of the claimed invention.

What is claimed is:

1. An assembly comprising a first riser and an identical second riser, the first riser having:

a first end which is circular and has an associated first diameter;

a second end which is circular and has an associated second diameter;

said first end and said second end spaced apart along a first central lengthwise axis;

a first wall, running from the first end to the second end, having the shape of a truncated hollow cone centered on said first central lengthwise axis;

a plurality of first tabs spaced apart around the circumference of the first end, each first tab comprising angled circumferential direction-facing opposing ends and a radially extending lip comprising a first notch shaped to accommodate a first boss and a first screw;

a plurality of first rim segments spaced apart around the circumference of the first end, wherein each first rim segment comprises the first boss configured to receive the first screw;

a plurality of second tabs spaced apart around the circumference of the second end, each second tab having angled circumferential direction-facing opposing ends and a radially extending lip comprising a second notch shaped to accommodate a second boss and a second screw;

a plurality of second rim segments spaced apart around the circumference of the second end wherein each second rim segment is positioned in a space between a pair of second tabs and wherein each second rim segment comprises the second boss configured to receive the second screw;

the second riser having:

a third end which is circular and has an associated third diameter;

a fourth end which is circular and has an associated fourth diameter;

said third end and said fourth end spaced apart along a second central lengthwise axis;

a second wall, running from the third end to the fourth end, having the shape of a truncated hollow cone centered on said second central lengthwise axis;

a plurality of third tabs spaced apart around the circumference of the third end, each third tab having angled circumferential direction-facing opposing ends and a radially extending lip comprising a third notch shaped to accommodate a third boss and a third screw;

a plurality of third rim segments spaced apart around the circumference of the third end, wherein each third rim segment comprises the third boss configured to receive the third screw;

a plurality of fourth tabs spaced apart around the circumference of the fourth end, each fourth tab having angled circumferential direction-facing opposing ends and a radially extending lip comprising a fourth notch shaped to accommodate a fourth boss and a fourth screw; and, a plurality of fourth rim segments spaced apart around the circumference of the fourth end, wherein each fourth rim segment is positioned in a space between a pair of fourth tabs, wherein each fourth rim segment comprises the fourth boss configured to receive the fourth screw;

wherein, the first riser and the second riser are configured to mate with each other to form a circumferential joint between either the first end of the first riser and the third end of the second riser, or between the second end of the first riser and the fourth end of the second riser;

wherein, when said circumferential joint is between the first end of the first riser and the third end of the second riser, each first tab is engaged with a third rim segment and each third tab is engaged with a first rim segment;

wherein, when said circumferential joint is between the second end of the first riser and the fourth end of the second riser, each second tab is engaged with a fourth rim segment and each fourth tab is engaged with a second rim segment;

wherein each of the engagements between the first, second, third, and fourth tabs and the respective rim segments includes a radially deflecting engagement between the radially extending lip of the tabs and the rim segments.

2. The assembly of claim 1, wherein when said circumferential joint is situated between the first end of the first riser and the third end of the second riser, the angled circumferential direction-facing end of each first tab abuts an angled circumferential direction-facing end of a third tab; and when said circumferential joint is situated between the second end of the first riser and the fourth end of the second riser, the angled circumferential direction-facing end of each second tab abuts an angled circumferential direction-facing end of a fourth tab.

3. The riser assembly of claim 1, wherein the first end of the first riser has a greater diameter than a diameter of the second end of the first riser; and the third end of the second riser has a greater diameter than a diameter of the fourth end of the second riser.

4. The riser assembly of claim 1, wherein said circumferential joint is situated between the first end of the first riser and the third end of the second riser, the riser assembly further having a gasket or seal contained within a groove in said circumferential joint.

5. The assembly of claim 1 in combination with a septic tank having a top-opening, wherein the assembly is attached to said opening.

6. The riser assembly of claim 1, wherein the radially extending lips of the plurality of first tabs extend inwards towards the first central lengthwise axis; and wherein the radially extending lips of the plurality of third tabs extend inwards towards the second central lengthwise axis.

7. The riser assembly of claim 6, wherein the radially extending lips of the plurality of second tabs extend outwards away from the first central lengthwise axis; and wherein the radially extending lips of the plurality of fourth tabs extend outwards away from the second central lengthwise axis.

8. An assembly comprising a first riser and an identical second riser, the first riser having:

a first end being circular and having a first diameter;

a second end being circular and having a second diameter;

said first end and said second end being spaced apart along a first central lengthwise axis;

a first wall, running from the first end to the second end, having the shape of a truncated hollow cone centered on said first central lengthwise axis;

a plurality of first tabs spaced apart around the circumference of the first end, each first tab comprising circumferential direction-facing opposing ends and a radially extending lip comprising a first notch shaped to accommodate a first boss and a first screw;

a plurality of first rim segments spaced apart around the circumference of the first end, wherein each first rim segment comprises the first boss configured to receive the first screw;

a plurality of second tabs spaced apart around the circumference of the second end, each second tab having circumferential direction-facing opposing ends and a radially extending lip comprising a second notch shaped to accommodate a second boss and a second screw;

a plurality of second rim segments spaced apart around the circumference of the second end wherein each second rim segment is positioned in a space between a pair of second tabs and wherein each second rim segment comprises the second boss configured to receive the second screw;

the second riser having:

a third end which is circular and has an associated third diameter;

a fourth end which is circular and has an associated fourth diameter;

said third end and said fourth end spaced apart along a second central lengthwise axis;

a second wall, running from the third end to the fourth end, having the shape of a truncated hollow cone centered on said second central lengthwise axis;

a plurality of third tabs spaced apart around the circumference of the third end, each third tab having angled circumferential direction-facing opposing ends and a radially extending lip comprising a third notch shaped to accommodate a third boss and a third screw;

a plurality of third rim segments spaced apart around the circumference of the third end, wherein each third rim segment comprises the third boss configured to receive the third screw;

a plurality of fourth tabs spaced apart around the circumference of the fourth end, each fourth tab having angled circumferential direction-facing opposing ends and a radially extending lip comprising a fourth notch shaped to accommodate a fourth boss and a fourth screw; and, a plurality of fourth rim segments spaced apart around the circumference of the fourth end, wherein each fourth rim segment is positioned in a space between a pair of fourth tabs, wherein each fourth rim segment comprises the fourth boss configured to receive the fourth screw;

wherein, the first riser and the second riser are configured to mate with each other to form a circumferential joint between either the first end of the first riser and the third end of the second riser, or between the second end of the first riser and the fourth end of the second riser;

wherein, when said circumferential joint is between the first end of the first riser and the third end of the second riser, each first tab is engaged with a third rim segment and each third tab is engaged with a first rim segment;

wherein, when said circumferential joint is situated between the second end of the first riser and the fourth end of the second riser, each second tab is engaged with a fourth rim segment and each fourth tab is engaged with a second rim segment;

wherein each of the engagements between the first, second, third, and fourth tabs and the respective rim segments includes the first, second, third, and fourth screws secured within the first, second, third, and fourth bosses.

9. The assembly of claim 8 wherein, each circumferential direction-facing end of each tab of the first riser is angled with respect to a plane within which lies the central lengthwise axis of the first riser; and, each circumferential direction-facing end of each tab of the second riser is angled with respect to a plane within which lies the central lengthwise axis of the second riser.

10. The riser assembly of claim 8 wherein, the first end of the first riser has a greater diameter than a diameter of the second end of the first riser; and the third end of the second riser has a greater diameter than a diameter of the fourth end of the second riser.

11. The riser assembly of claim 8, wherein said circumferential joint is situated between the first end of the first riser and the third end of the second riser, the riser assembly further having a gasket or seal contained within a groove in said circumferential joint.

12. The assembly of claim 8 in combination with a septic tank having a top-opening, wherein the assembly is attached to said opening.

13. The riser assembly of claim 8, wherein the radially extending lips of the plurality of first tabs extend inwards towards the first central lengthwise axis; and wherein the radially extending lips of the plurality of third tabs extend inwards towards the second central lengthwise axis.

14. The riser assembly of claim 13, wherein the radially extending lips of the plurality of second tabs extend outwards away from the first central lengthwise axis; and wherein the radially extending lips of the plurality of fourth tabs extend outwards away from the second central lengthwise axis.

* * * * *